US010208416B2

(12) United States Patent
Taylor et al.

(10) Patent No.: US 10,208,416 B2
(45) Date of Patent: Feb. 19, 2019

(54) HOOPING STATION

(71) Applicant: Durkee Embroidery, Inc., Davidson, NC (US)

(72) Inventors: Claude Brent Taylor, Davidson, NC (US); Curtis Todd Boyter, Gastonia, NC (US)

(73) Assignee: DURKEE EMBROIDERY, INC., Davidson, NC (US)

( * ) Notice: Subject to any disclaimer, the term of this patent is extended or adjusted under 35 U.S.C. 154(b) by 303 days.

(21) Appl. No.: 15/159,773

(22) Filed: May 19, 2016

(65) Prior Publication Data

US 2016/0340817 A1 Nov. 24, 2016

Related U.S. Application Data

(60) Provisional application No. 62/163,704, filed on May 19, 2015.

(51) Int. Cl.
*D05C 9/04* (2006.01)
*D05B 79/00* (2006.01)

(52) U.S. Cl.
CPC ..... *D05C 9/04* (2013.01); *D05B 79/00* (2013.01); *D05D 2305/00* (2013.01)

(58) Field of Classification Search
CPC ..... D05C 9/00–9/22; D05B 79/00; D05D 2305/00
USPC ..... 112/103
See application file for complete search history.

(56) References Cited

U.S. PATENT DOCUMENTS 2,751,869 A * 6/1956 Walcoff ..... D05C 9/04 112/136
4,561,177 A * 12/1985 Rancer ..... B23P 19/04 269/307
4,774,778 A * 10/1988 Williams ..... D05C 9/04 112/78
4,805,297 A * 2/1989 Seneff ..... B23P 19/02 248/176.1
4,869,183 A * 9/1989 Moore, III ..... D05C 9/04 112/103
5,432,990 A * 7/1995 Seneff ..... D05C 13/00 108/102
5,590,613 A * 1/1997 Head ..... D05C 9/04 112/103
5,598,797 A * 2/1997 Patterson ..... D05B 39/00 112/103
5,802,704 A * 9/1998 Woody ..... D05C 1/02 192/132
5,970,895 A * 10/1999 Mack ..... D05C 9/04 112/103
5,992,339 A * 11/1999 Mack ..... D05C 9/04 112/103

(Continued)

*Primary Examiner* — Danny Worrell
*Assistant Examiner* — Griffin Hall
(74) *Attorney, Agent, or Firm* — Trego, Hines & Ladenheim, PLLC; Thomas McClure; Jonathan Hines

(57) ABSTRACT

A hooping station for an embroidery machine, that includes a base configured to receive a garment. A plurality of tracks are formed in the base and a plurality of bumpers are configured to fit within the tracks. At least a first bumper is configured to engage the first track the predetermined position. A light source is configured to form a light mark that is in a predetermined location relative to the first bumper.

14 Claims, 8 Drawing Sheets

(56) References Cited

U.S. PATENT DOCUMENTS

| | | | | | |
|---|---|---|---|---|---|
| 6,067,737 | A * | 5/2000 | Guenther | D05C 9/04 | 112/103 |
| 6,138,592 | A * | 10/2000 | Seneff | D05C 13/00 | 112/103 |
| 6,216,617 | B1 * | 4/2001 | Burt, Jr. | D05C 9/04 | 112/103 |
| 6,298,800 | B1 * | 10/2001 | Gala | D05C 9/04 | 112/103 |
| 7,527,004 | B1 * | 5/2009 | White | D05B 39/00 | 112/103 |
| 8,584,606 | B2 * | 11/2013 | Mack | D05B 39/00 | 112/103 |

* cited by examiner

HOOPING STATION

BACKGROUND OF THE INVENTION

The present invention relates to hooping stations for embroidery machines, and more specifically, to a hooping station configured such that many different garments of a predetermined style can be aligned with an embroidery machine such that an embroidered pattern can be positioned on each garment in a relatively similar position.

Hooping stations are used in the embroidery industry to align garments with embroidery machines. Such stations include a base on which a garment is positioned. The base is aligned with an embroidery machine so that a design can be embroidered on the mounted garment in a predetermined position. It is generally desirable that hooping stations be in a position that is fixed relative to the embroidery machine so that designs can be applied to garments is substantially the same relative position on each garment.

One problem with conventional hooping stations is that it is difficult to align garments on the hooping stations such that the repeatability that can be provided by the fixed relative position of the hooping station to the embroidery machine is actually achieved. Therefore there is a need for an apparatus that is configured to position garments such that the desired location of the design to be embroidered is consistently positioned relative to the embroidery machine.

BRIEF DESCRIPTION OF THE INVENTION

This need is addressed by a hooping station that includes a light source capable of marking with light a predetermined location relative to an embroidery machine such that a garment can be aligned with the embroidery machine by using the light source mark as a reference.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
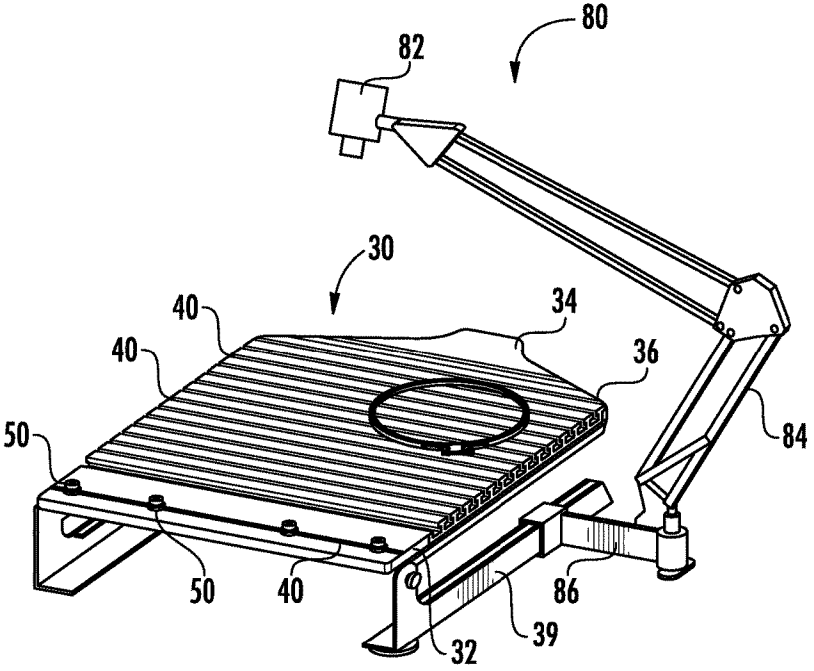
FIG. 1 shows a perspective view of a hooping station according to the present invention.
Figure 7:
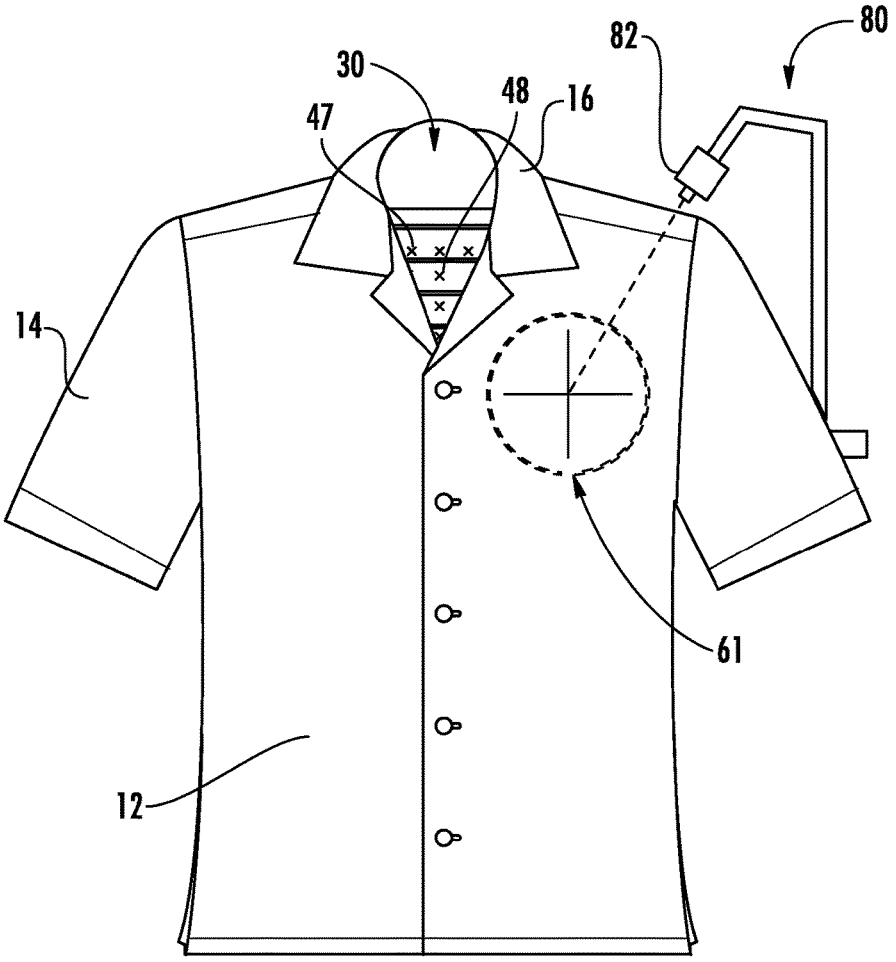
FIG. 7 shows an overhead plan view of a hooping station having a garment positioned thereon to determine a desired location, i.e., the position of the embroidery design, to be indicated by a light mark at a predetermined location.

Referring to the drawings wherein identical reference numerals denote the same elements throughout the various views, FIG. 1 shows a hooping station 10 according to the present invention configured to have a garment 12 mounted on it. The garment 12 as shown in FIG. 7 includes a sleeve 14, a collar 16, and a throat 18. The hooping station 10 includes a hooping base 30, a track 40, a bumper 50, a hoop 60, a backing holder 70, and a light 80.

Figure 13:
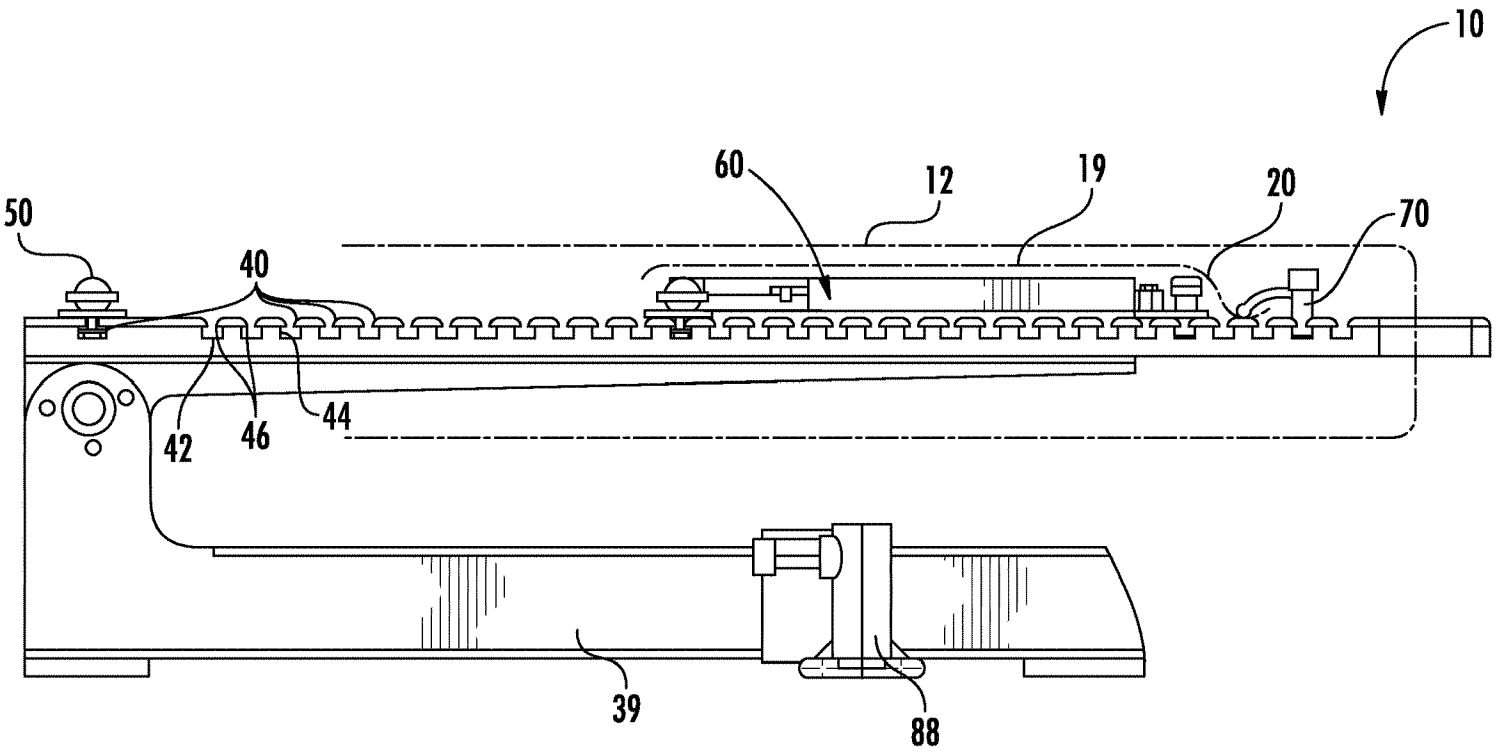
FIG. 13 shows a partially cutaway side view of a hooping station according to the present invention with a garment mounted on it.
Figure 14:
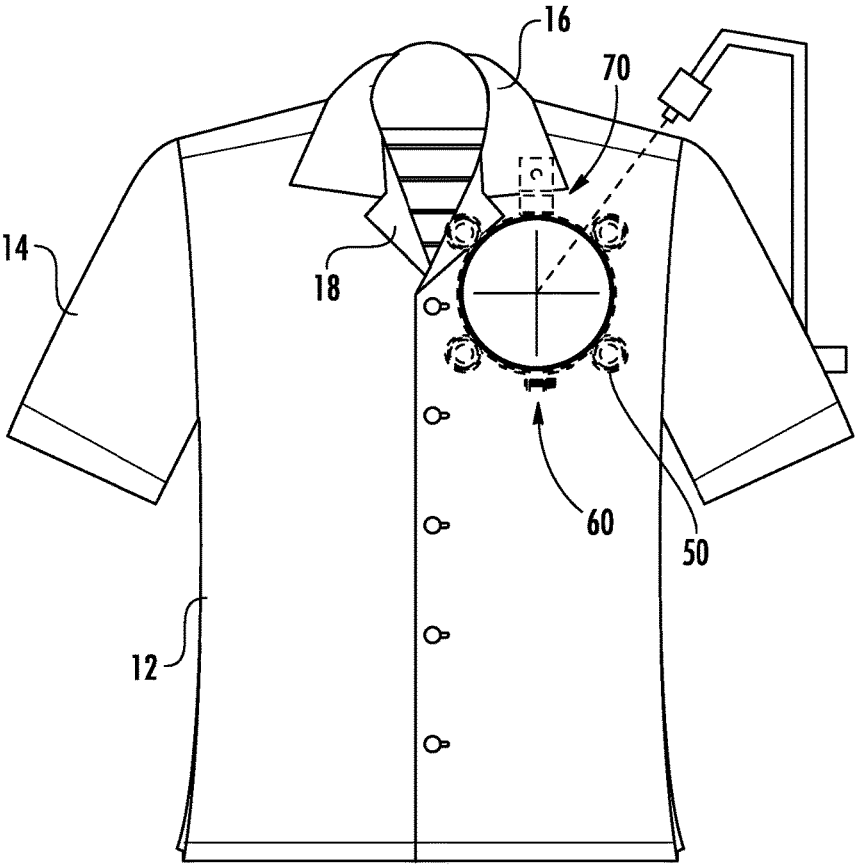
FIG. 14 shows a garment positioned on a base and ready to be embroidered.

Continuing to refer to FIGS. 1 and 7, the hooping base 30 is configured to receive garment 12 fitted over it. The hooping base 30 includes a waist 32, a neck 34, a shoulder 36, and a rail 39. The hooping base 30 includes two generally parallel sides that oppose each other. The neck 34 is positioned between the two sides opposite the waist 32. A plurality of tracks 40 are defined in the hooping base 30 and extend across the base. The tracks 40 are arranged parallel to each other between the neck 34 and the waist 32. Referring now to FIG. 13, each track 40 includes a bottom 42 and two opposing sidewalls 44 that extend up from the bottom 42. Positioned at one end of each of the sidewalls 44 opposite the bottom 42 is a lip 46 such that each track 40 includes a pair of opposing lips 46. A plurality of indicating marks 47 are located horizontally on the base 30 and a plurality of indicating marks 48 are located vertically on the base 30. Together the indicating marks 47 and 48, coordinate system they can be used to determine a repeatable position on the base 30. By way of example and not limitation, the indicating marks 47 and 48 can be one of the following: letters, numbers, symbols, geometric shapes, abstract marks, and a combination thereof. In one embodiment, the indicating marks 47 and 48 define a XY coordinate system.

Figure 2:
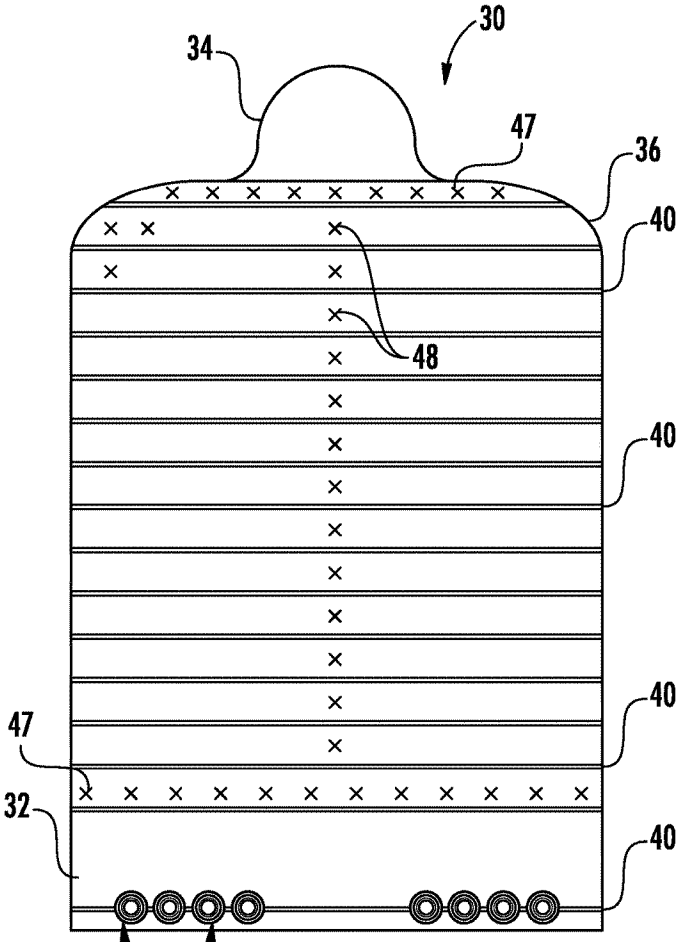
FIG. 2 shows an overhead planar view of an embroidery hooping base.
Figure 3A:
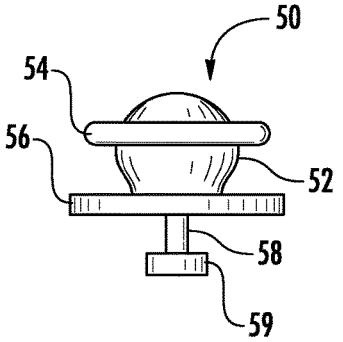
FIG. 3A shows a side view of a bumper configured to be used with the hooping base of FIG. 2.
Figure 3B:
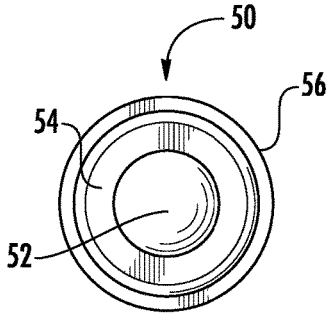
FIG. 3B shows a planar of a bumper configured to be used with the hooping base of FIG. 2

Referring now to FIG. 2, FIG. 3A, and FIG. 3B; the hooping base 30 also includes a lowest most track 40 positioned near the waist 32 of the hooping base 30 and spaced away from the other tracks 40. This track 40 is known as "a bumper track" and is configured to receive a plurality of bumpers 50 for storage. Each of the bumpers 50 includes a body 52 that has a rim 54 positioned around it. The body 52 is generally a spheroid and in the illustrated embodiment the rim 54 is positioned just above the widest point of the body 52. A bumper flange 56 is attached to the body 52 such that the bumper flange 56 is substantially parallel to a plane defined by the rim 54. A stem 58 extends away from the bumper flange 56 coincident to an imaginary axis of the rim 54 and the bumper flange 56. The stem 58 connects a foot 59 to the body 52 of the bumper 50. The stem 58 is configured to extend into any of the tracks 40 such that the foot 59 prevented from being extracted directly from the track 40 other than through the open end by the opposing lips 46 of the respective track 40. At least one end of each track 40 is open such that a bumper 50 can be engaged with the track 40 by sliding the bumper 50 into the open end of the track 40.

Figure 4:
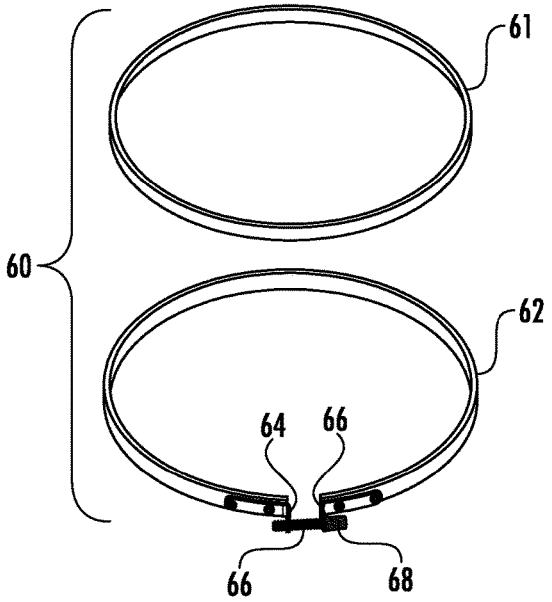
FIG. 4 shows a perspective exploded view of an embroidery hoop to be used with the hooping base of FIG. 2.
Figure 5:
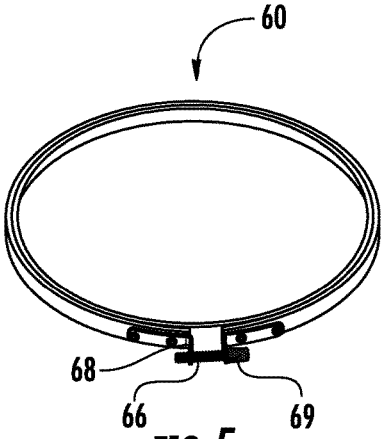
FIG. 5 shows a perspective view of the embroidery hoop of FIG. 4.

Referring now to FIG. 4 and FIG. 5, a hoop 60 is configured to be used with the hooping base 30. The hoop 60 includes an inner ring 61 and an outer ring 62. The inner ring 61 is configured to be positioned within the outer ring 62 such that a portion of the garment 12 is captured therebetween. The outer ring 62 includes a first tab 63 that extends from a first end 64 and a second tab 65 that extends from a second end 66. A threaded screw 68 extends between the first tab 63 and the second tab 65 and is configured to turn such that the spacing between the first tab 63 and the second tab 65 can be adjusted and substantially fixed. In this manner the hoop 60 can be adjusted to capture fabrics of different thickness and surface friction. In the illustrated embodiment, the hoop 60 is round. It should be appreciated alternative embodiments the hoop 60 can be square or rectangular or another geometric shape.

Figure 6A:
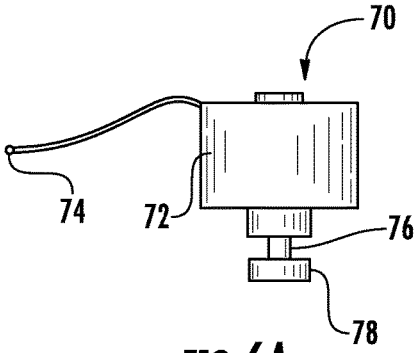
FIG. 6A shows a side view of a backing holder to be used with the hooping base of FIG. 2.
Figure 6B:
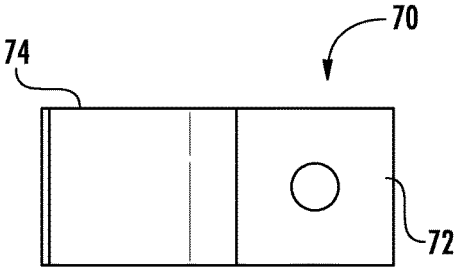
FIG. 6B shows a planar of a backing holder to be used with the hooping base of FIG. 2.

Referring to FIG. 6A and to FIG. 6B a backing holder 70 is provided. The backing holder 70 includes a body 72 from which a tab 74 extends. A stem 76 also extends from the body 72 and supports a backing holder foot 78. The backing holder foot 78 is configured such that the backing holder 70 can be received and retained in a track 40. The backing holder 70 can be inserted into one of the tracks 40 and moved relative to it and retained by the track 40 in a manner substantially similar to how a bumper 50 is inserted, moved relative to, and retained by the track 40. The tab 74 extends from the body 72 of the backing holder 70 and is configured to retain a backing material 19 positioned over the hoop 60.

As shown in FIG. 7, a light 80 is configured to be positioned near the hooping base 30. The light 80 includes a light source 82 defined on a light arm 84. The light arm 84 is configured such that light source 82 can be repositioned as required to generate a defined light marked on the garment 12. In the embodiment shown, the light arm 84 extends from a light source attachment 86 that includes a bracket 88 defined to engage the rail 39 of the hooping base 30. The bracket 88 allows the light 80 to be moved relative to the makes 30 but to be retained near the base 30. The light source 82 can be configured to generate a simple point light or a cross, x-shape, or other geometric pattern. The shape or pattern that the light source 82 generates can be chosen such that positioning of the light mark is made easy relative to the indicating marks 47 and 48. For example the center of a cross can be positioned at a predetermined set of X and Y coordinates which is facilitated by the extension of arms of the cross extending near the indicating marks 47 and 48.

The present invention can be better understood from the description of the operation thereof. Referring now to FIG. 7, the light source 82 is positioned such that a mark formed of light (similar to that defined by laser pointer) is in a predetermined location on base 30. The location of the light mark is chosen to represent the position of a predetermined portion of the embroidered design. In the illustrated example, the position of the light mark is chosen to represent the center of the embroidered design.

The desired predetermined position is located by first positioning a garment 12 of the style to be embroidered on the base 30 is seen in FIG. 7. Preferably the garment 12 is fully buttoned. Indicating marks 47 and 48 should be visible through the neck 16 of the garment 12. The indicating marks 47 and 48 should be noted. In some embodiments the indicating marks 47 and 48 are letters in the letters that appear at the coping 16 should be noted. This designated letter will provide a reference point for placing subsequent garment 12's of the same size and style to ensure consistent embroidery design placement. The light 80 is adjusted such that the light mark is projecting on the shirt and a location about which the embroidery design will be centered.

Figure 8:
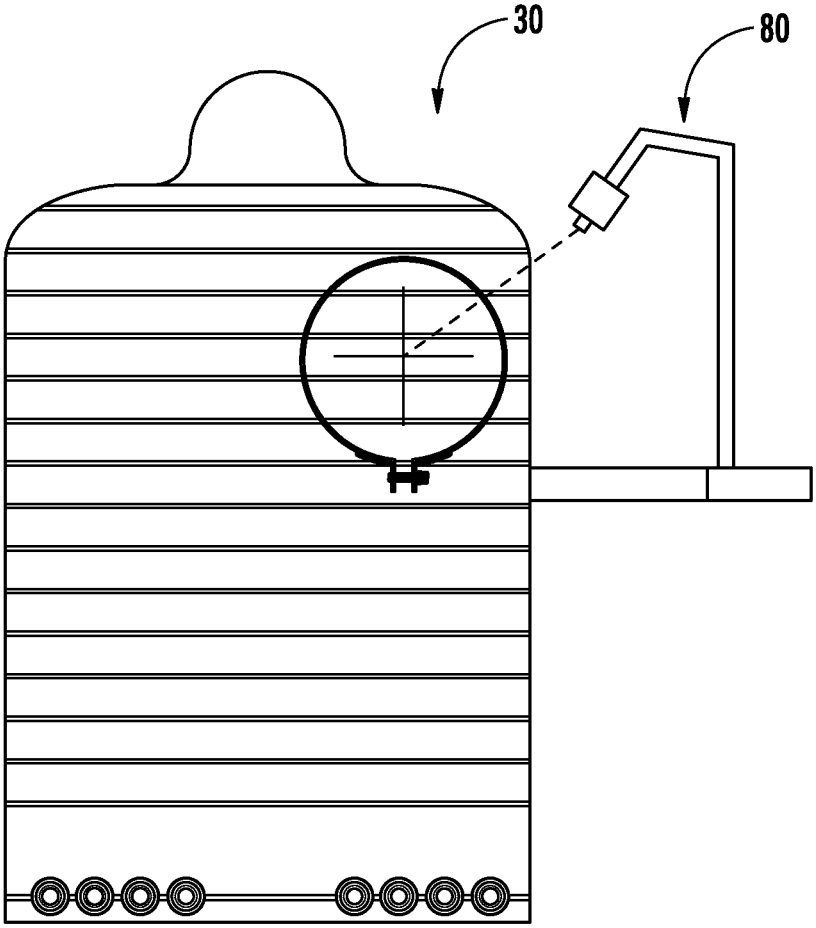
FIG. 8 shows a hooping station having the outer ring of a positioned relative to the predetermined location marked by a light mark—

Referring now to FIG. 8, the shirt is then removed from the base 30. The light is now projecting the light mark onto the base 30. Position the outer hoop 62 of the hoop 60 such that the light mark is centered within the outer hoop 62.

Figure 10:
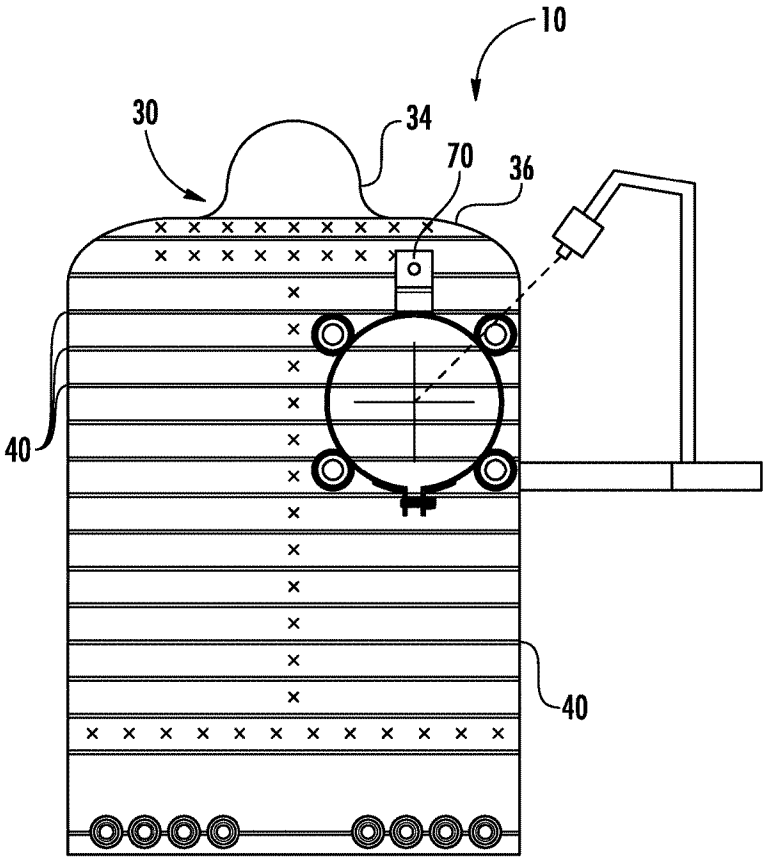
FIG. 10 shows a backing holder positioned relative to the embroidery hoop shown in FIG. 9.
Figure 9:
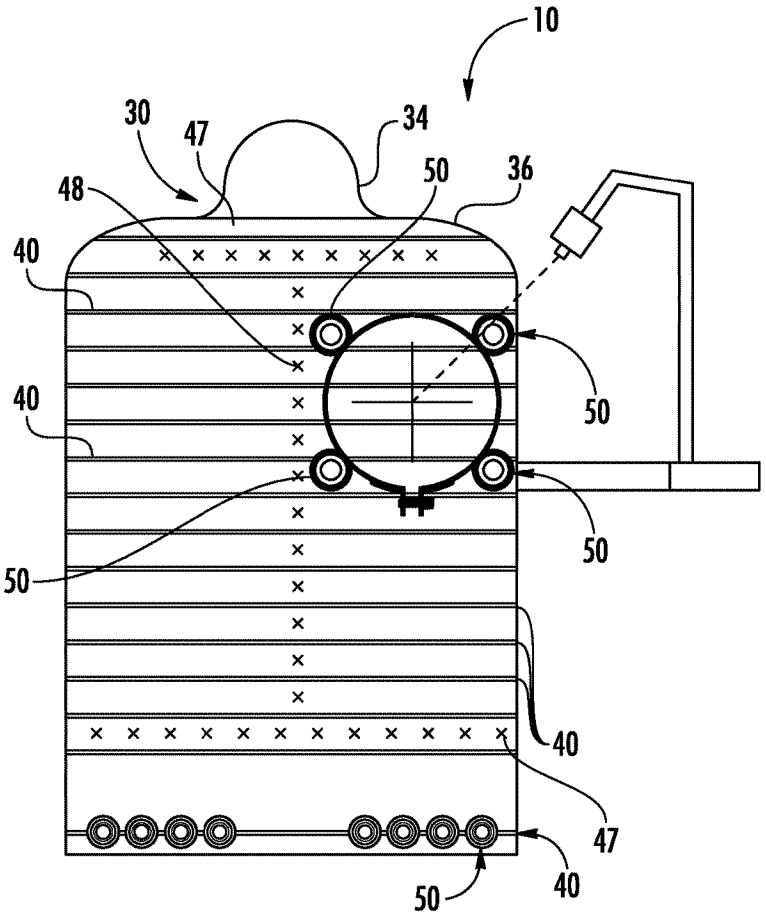
FIG. 9 shows a embroidery hoop positioned in place by the bumpers.
Figure 11:
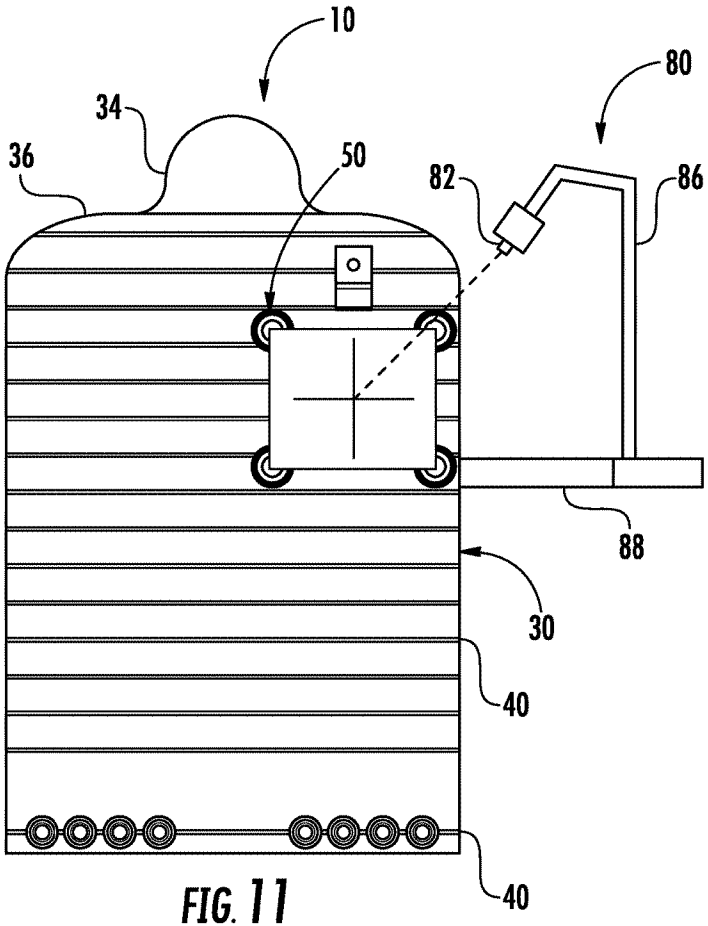
FIG. 11 shows the embroidery backing positioned over the embroidery hoop and held in place by the backing holder such that the predetermined location marked by light shows on the embroidery backing.

In this manner, the position of the light mark and the hoop 60 are chosen in anticipation of where the garment 12 will be placed. The plurality of bumpers 50 are positioned such that they are spaced against the outer hoop 62 around the light mark as shown in FIG. 9. In this regard, the plurality of bumpers 50 are in a fixed position relative to the light mark. The outer ring 62 of the hoop 60 is placed such that it is supported by the bumpers 50. The outer ring 62 of the hoop 60 can be positioned such that is spaced away from the base 30 by at least one bumper flight 56. As shown in FIG. 10, a backing holder 70 is placed in a track 40 such that the tab 74 of the backing holder 70 extends over the hoop 60. Backing material 19 is then placed over the hoop 60 such that the backing material 19 is retained by the backing holder 70 as shown in FIG. 11. It should be appreciated that the step of positioning the light mark can be performed after the step of placing the hoop 60 and the backing material 19.

Figure 12:
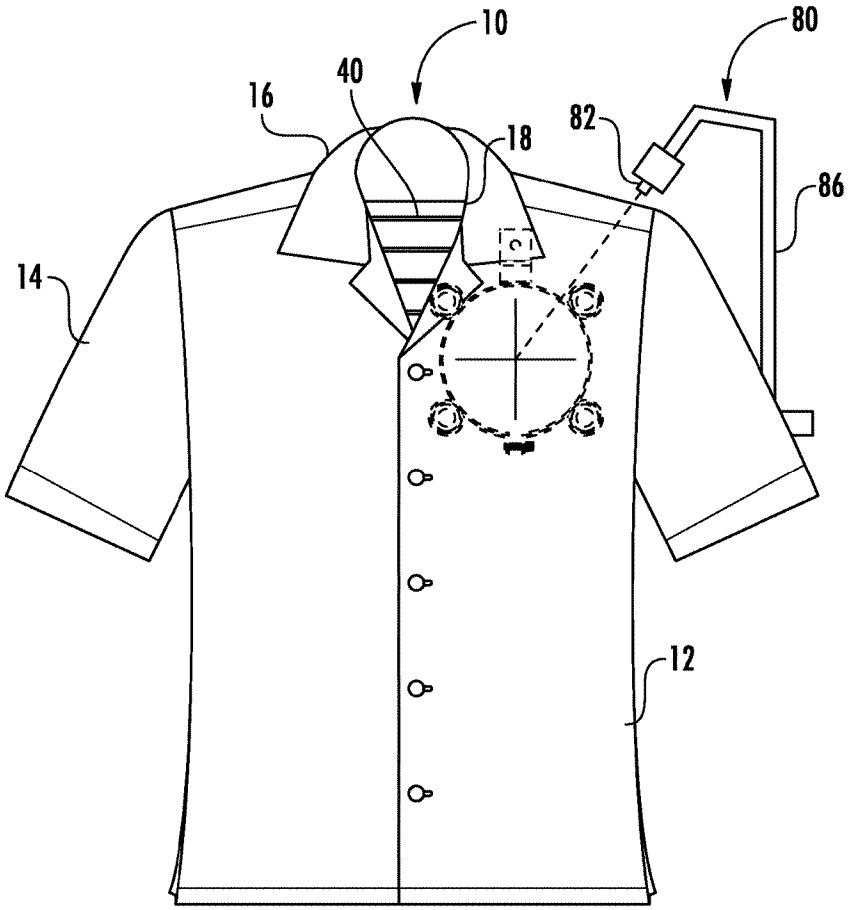
FIG. 12 shows a garment positioned on an hooping station according to the present invention having the light marked positioned shown thereon.

Referring now to FIG. 12, a garment 12 is placed over the hooping base 30. As illustrated, the garment 12 is a shirt that is open at a waist. When the garment 12 is placed over the hooping base 30, the neck 34 of the hooping base 30 is positioned through the waste of the garment 12 until the next 34 protrudes through the collar opening 16 of the garment 12. The neck 34 of the hooping base 30 extends through the caller opening and operates to position the garment 12 relative to the hooping base 30. The garment 12 is more precisely positioned by observing the light mark defined by light source 82 as it appears on the left breast of the garment 12. The garment 12 is moved until the light mark lines up with the proposed center of the embroidered designed to be placed on garment 12. The center could be indicated on the garment 12 by the position of a pocket or measured from a consistent location such as the position of the collar or sleeve of the garment 12. The shape of the hooping base 30 is such that the garment 12 is generally positioned close to the desired location. Some further adjustment might be needed such that the light mark and the proposed center of the embroidered design are aligned.

Once the garment 12 is positioned as desired relative to the light mark, the embroidery machine is operated to place the embroidered design on the garment 12. After the embroidered designed has been placed on the garment 12, the garment 12 along with the hoop 60 is removed from the hooping station 30. The screw 68 can loosened such that outer ring 62 can be removed from contact with the garment 12 such that garment 12 is not capture between the outer ring 62 and the inner ring 61. According to one embodiment, the inner hoop 61 and the garment 12 can be removed together such that the outer hoop 62 remains on the base. Another backing material is fitted into backing material holder 70. Another shirt can be fitted over the base 30 such that the neck 16 aligns with the predetermined indicating marks 47 and 48 in the inner hoop 61 can be placed within the outer hoop 62 to capture the shirt. It should be noted that these steps have occurred without movement of the light source 82 relative to the base 30. After the garment 12 is removed the above steps can be repeated to embroider a new garment 12 with the design in substantially the same position. This process can be repeated to quickly position is sequentially embroider many garments 12.

The foregoing has described a hooping station that is configured to mark a predetermined location on a garment using light. The hooping station provides advantage of being able to positioned subsequent garments of similar styles on the hooping station in the same position relative to the light mark. An advantage over conventional methods of embroidery and conventional hooping stations that the present invention provides is that sequential garments can be embroidered in substantially the same location relative to the garment style. This can be done more quickly and more consistently than with conventional methods of embroidery. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying potential points of novelty, abstract and drawings), or to any novel one, or any novel combination, of the steps of any method or process so disclosed.

What is claimed is:

1. A hooping station for an embroidery machine, the hooping station:

a base configured to receive a garment;

a plurality of tracks formed in the base;

a first bumper configured to engage a first track at a predetermined position;

a light source that is movable relative to the base; and wherein the light source is configured to form a light mark that is in a predetermined location relative to the first bumper.

2. The hooping station according to claim 1, wherein the first bumper is configured to support a hoop in a predetermined location that is repeatable relative to the light mark.

3. The hooping station according to claim 2, wherein a second bumper is configured to engage a second track at a predetermined position such that the second bumper is configured to support the hoop along with the first bumper.

4. The hooping station according to claim three, wherein the second track is the same as the first track.

5. The hooping station according to claim three, wherein the second track is different than the first track.

6. The hooping station according to claim 2, wherein the base is configured to receive a first garment having arms and a neck opening such that the light mark illuminates a predetermined location relative to the arms and the neck opening.

7. The hooping station according to claim six wherein the base is configured to receive a second garment that is substantially similar to the first garment such that the light mark illuminates a substantially similar predetermined location relative to the positions of the arms and of the neck opening of the first garment.

8. A hooping station for an embroidery machine, the hooping station comprising:

a base;

a plurality of tracks;

a plurality of bumpers configured to be received within the tracks;

a light source fixed to the base and movable relative to the base and configured to generate a light mark;

and wherein the light mark is configured to remain in a predetermined location while sequential garments are sequentially attached and removed from the base.

9. A method for positioning a garment relative to an embroidery machine, the method comprising the steps of:

providing a base, a plurality of tracks, a plurality of bumpers configured to be received within the tracks, a light source that is movable relative to the base and configured to generate a light mark, and wherein the light mark is configured to remain in a predetermined location while sequential garments are added to and removed from the base;

positioning the light source such that a light mark is visible on the base;

choosing the location of the light mark such that it represents a position of a predetermined portion of an embroidered design on a garment.

10. The method according to claim 9, further comprising the steps of:

positioning an outer hoop ring such that the light mark is centered within the hoop.

11. The method according claim 10, further comprising the step of:

positioning the plurality of bumpers such that they are in a fixed position relative to the light mark and the outer hoop ring.

12. The method according to claim 10, further comprising the step of retaining the position of the outer hoop ring with the bumpers.

13. The method according to claim 9, further comprising the step of:

sliding a backing holder into the track above the outer hoop ring.

14. The method according to claim 13, further comprising the step of: positioning backing within the backing holder such that the backing extends over the outer hoop ring.

* * * * *